United States Patent [19]

Attaway

[11] Patent Number: 4,545,162

[45] Date of Patent: Oct. 8, 1985

[54] MOLDINGS

[75] Inventor: Julian J. Attaway, Tucker, Ga.

[73] Assignee: MM Systems Corporation, Tucker, Ga.

[21] Appl. No.: 491,902

[22] Filed: May 5, 1983

[51] Int. Cl.[4] ..... E04B 5/00

[52] U.S. Cl. ..... 52/255; 52/288; 52/716

[58] Field of Search ..... 52/288, 287, 255, 256, 52/257, 461, 716, 717, 718, 460, 465, 468

[56] References Cited

U.S. PATENT DOCUMENTS

| | | | |
|---|---|---|---|
| 290,750 | 12/1883 | Da Cunha | 52/255 |
| 1,910,554 | 5/1933 | Loehr | 52/717 |
| 3,056,233 | 10/1962 | McNulty | 52/461 |
| 3,199,258 | 8/1965 | Jentoft | 52/461 |
| 3,334,462 | 8/1967 | Brooks | 52/460 |
| 3,380,210 | 4/1968 | Neal | 52/468 |
| 3,486,283 | 12/1969 | Arnett | 52/288 |
| 3,494,085 | 2/1970 | Van Bael | 52/287 |
| 3,553,915 | 1/1971 | Passovoy | 52/460 |
| 3,606,714 | 9/1971 | Arnett | 52/288 |
| 3,712,015 | 1/1973 | Nelson | 52/729 |
| 3,866,372 | 2/1975 | Haage | 52/729 |
| 4,086,739 | 5/1978 | Hall | 52/468 |
| 4,091,586 | 5/1978 | Schwartz | 52/288 |
| 4,156,999 | 6/1979 | Avery | 52/729 |
| 4,200,261 | 4/1980 | Bartlett | 52/718 |
| 4,430,833 | 2/1984 | Balzer | 52/255 |

FOREIGN PATENT DOCUMENTS

| | | | |
|---|---|---|---|
| 74646 | 7/1970 | Belgium | 52/288 |
| 2518049 | 3/1976 | Fed. Rep. of Germany | 52/465 |
| 1175346 | 3/1959 | France | 52/288 |
| 352481 | 4/1961 | Switzerland | 52/468 |
| 392025 | 9/1965 | Switzerland | 52/255 |

*Primary Examiner*—Henry E. Raduazo

*Attorney, Agent, or Firm*—John B. Armentrout

[57] ABSTRACT

Moldings which serve as grounds either for fluent settable or dry finish material, or both, are suited to be fastened against sub-structure of a building, and the molding includes a channel which interiorly is revealed forwardly as trim, the channel being disposed forwardly in the molding so as to be accompanied by coves formed in the molding at the rear of the channel, and so as to have fluent settable finish material enter and cleat in the related cove, where fluent settable finish material is selected for application outside the cove, to the molding.

36 Claims, 11 Drawing Figures

Figure 7:
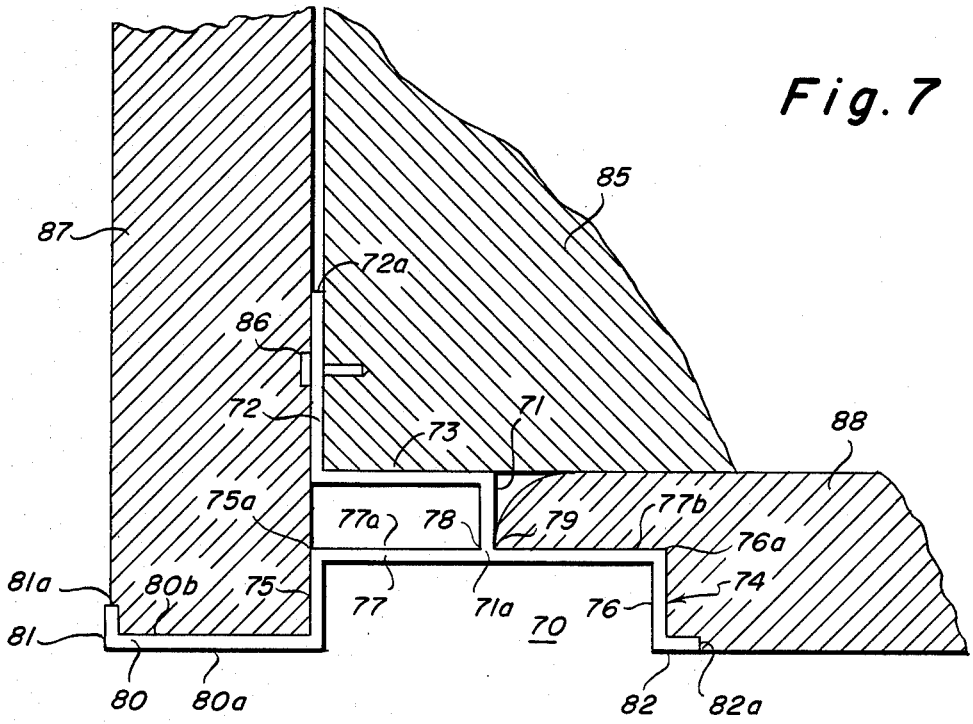
Figure 8:
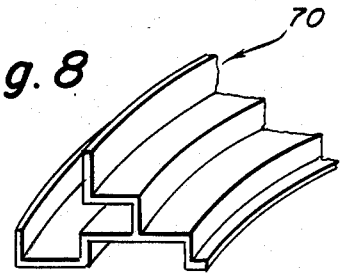
Figure 9:
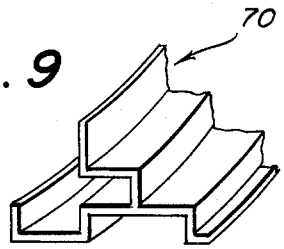
Figure 10:
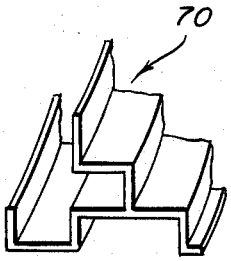
Figure 11:
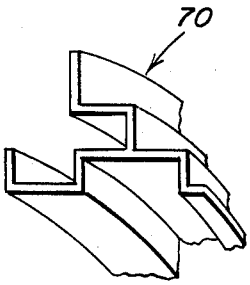

Fig. 1
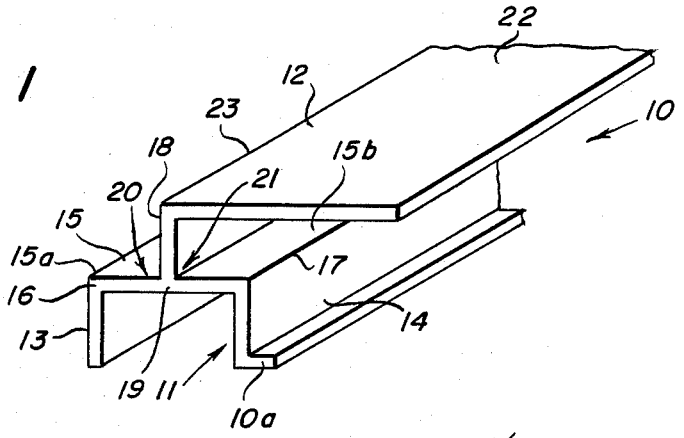
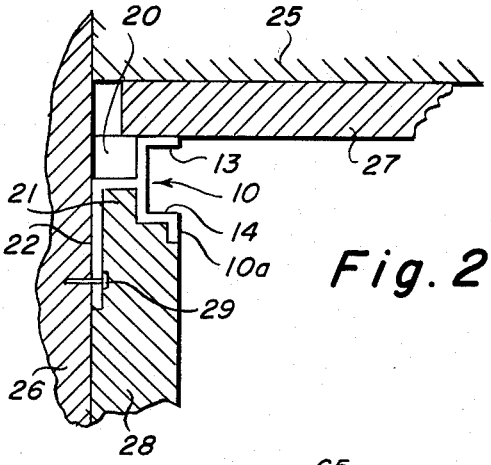
Fig. 2
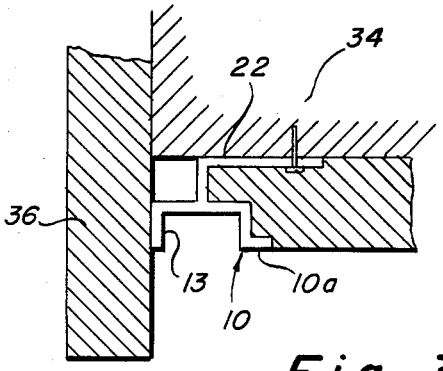
Fig. 3
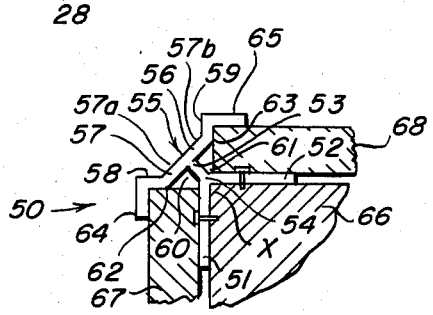
Fig. 6
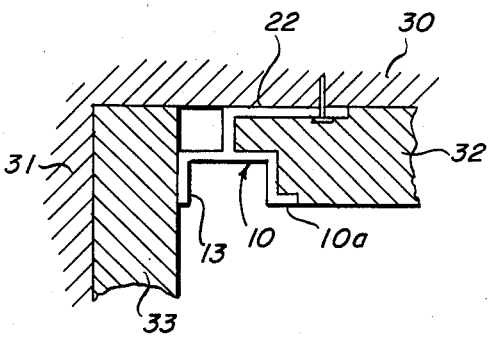
Fig. 4
Fig. 5
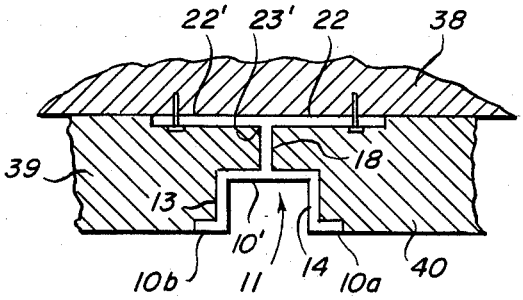

MOLDINGS

This invention relates to moldings which are adapted as shafts to be fastened to sub-structure of a building and be revealed to extents as trim along with finish structure of a building, and the invention also relates to building structures which are characterized by the molding being a component thereof.

An object of the present invention is the provision of structurally worthwhile moldings which are readily produced and easily installed and which for trim introduce a reveal including the interior of a channel, and are well suited for use with any of a variety of finish materials, such as paneling or board or wet applied settable plaster, available in the trade for covering sub-structure of a building, and which moldings in the instance of use with wet applied settable plaster may serve as a ground for the wet plaster, or which in the instance of dry paneling or board may serve as a ground for the dry paneling or board, having the moldings in either instance offer a reveal for trim.

A further object herein is that of providing moldings of the character indicated wherein the channel thereof is accompanied by coves formed in the molding with the rear of the channel, such as to allow wet plaster or the like to enter either or both of the coves, as the case may be, and take set, having a cleat in the cove.

Another object of this invention is to provide moldings of the character indicated having the channel situated forwardly in the molding so that a reveal represented by the interior of the channel is relatively easy to clean, and is visible in full depth of the channel from a wider angle of view, because of the channel being relatively shallow.

Other objects of this invention in part will be obvious and in part pointed out more fully hereinafter.

As conducive to a clearer understanding of certain features of the present invention, it is noted at this point that in the field of architectural trim and building construction it has become desirable to have moldings at hand which satisfactorily serve as grounds for finish material which at least in part is to be added after the moldings have been secured to sub-structure of a building, and moldings which furthermore ornamentally present a reveal when the molding is in place and is partially concealed by the finish material through treating the molding as a ground.

Moldings of the character indicated are for example in demand for use with finish material either or both of a dry pre-formed type or of a fluent settable grade which is to be added outside sub-structure of the building to opposite sides of the already installed molding as a ground on the sub-structure, thereafter to have the molding intermediately serve as trim. In other instances, demands reach into situations where a segment of the finish material has already been put into place on sub-structure of the building, allowing the molding thereafter to be installed on the sub-structure with one side of the molding against the segment, and then to have the molding on the opposite side serve as a ground for supplemental finish material to be added for covering the sub-structure. Fluent settable materials, such as plaster, of course are fluent when first brought against the molding and later take set, while so-called dry finish materials, such as panels or boards, in being used with the molding, are bodily put into place.

Frequently, moldings are needed for corner environments differing with whether the sub-structure of the building calls for about a 90° or about a 270° coverage measured outside the confronted faces of the sub-structural corner. To illustrate further, the corner environment may involve a side wall to side wall situation, a side wall up to a ceiling situation or a side wall down to a soffit situation. In other than corner environments, moldings also are sometimes required to serve as trim between first and second finished areas within, say, a wall or a ceiling outside the sub-structure of a building, and in all it has become desirable to have moldings of the character referred to available in varieties to select from in order to satisfy one or more specialized needs.

In accordance with the present invention, moldings which are well suited for the dual purpose of being grounds for finish material, and affording trim, are provided, and the molding is a shaft formed such as by extrusion, being made for example of an aluminum base alloy of any satisfactory type or, if desired, made of any other suitable material such as from an opaque grade of synthetic resin.

The molding shaft comprises, a reveal wall structure which intermediately of first and second lateral terminal ends thereof includes first and second side walls, and a web having first and second junctions with those side walls and forming an interiorly revealed channel with those side walls. Lead wall structure in the molding shaft introduces a stub wall having junction at a first end of the lead wall structure with the rear of the channel web marginally inwardly from the junctions of the channel side walls with the web. The stub wall is between first and second coves behind the channel web.

The lead wall structure is further characterized by including lead wall means providing a second end of the lead wall structure and being adapted to lead along sub-structure of a building and be fastened to that sub-structure in contact therewith. At least a portion of the lead wall means includes a lead wall forming a lead angle with the stub wall so as to have the stub wall offset the channel from the lead wall.

The lead wall structure and the channel are disposed and extend in the molding shaft relatively to one another, for the lead wall means to be accessible for being fastened in place against the building sub-structure and the channel to be interiorly revealed upon the lead wall means being fastened in place. Still further, the lead wall structure and the channel are disposed and extend relatively to one another in the molding shaft, for finish material, upon being disposed outside each of first and second extents of the sub-structure of the building and contiguous, outside the channel, respectively to the first and second lateral terminal ends of the reveal wall structure, to conceal the first and second extents of the sub-structure, the first and second coves, and the outside faces of the first and second side walls of the channel and, with regard to entering the spaces inside the first and second coves, be at farthest closely outside the first and second coves, while the interior of the channel remains revealed and the lead wall means still is fastened in place.

Molding shafts in accordance with the present invention not only serve as grounds for various finish materials, but as trim. Where the finish material is of a fluent settable type and is applied prior to setting, the material in being worked to the molding shaft for a ground, preferably is in depth to enter the related cove behind the channel and eventually set with a cleat in that cove.

It will also be appreciated that the molding shafts have utility as grounds and trim for dry finish materials and that the dry finish materials such as paneling or board can be presented contiguous to the molding shaft without entering the cove, or if desired in certain instances the paneling or board may be provided with a tongue which is entered into the cove.

Further aspects are that the molding shafts, by having, the channel offset in the molding shaft in a forward lateral direction, are characterized by the channel being relatively shallow, considering the extent of the offset. Accordingly the reveal afforded as trim by the interior of the channel, in also being relatively shallow, is more easily cleaned. The channel web portion of the reveal in the relatively shallow channel moreover is visible with a resulting ornamental effect from a wider angle of view than would be the case for a deeper channel.

In the accompanying drawings representing several illustrative embodiments of this invention which are presently preferred:

FIG. 1 is an isometric fragmentary view of a molding shaft;

FIGS. 2, 3 and 4 provide transverse cross sectional views of the molding shaft in FIG. 1 and in addition represent different environments wherein the molding shaft is associated with building sub-structure and finish materials;

FIGS. 5, 6 and 7 are views similar to the latter three figures, but involve modified forms of molding shafts and exemplify their use; and FIGS. 8, 9, 10 and 11 are isometric fragmentary views representing longitudinally curved molding shafts, having reference to the FIG. 7 embodiment.

Referring now more particularly to the embodiment represented in FIG. 1, a molding shaft, designated in general by the reference numeral 10, is characterized by including on the length thereof a forwardly laterally open channel 11, and lead wall structure 12 rearwardly of the channel 11 in the molding shaft 10. Channel 11 as shown in FIG. 1 is defined by a web laterally straigt 15 and by laterally straight first and second side walls 13 and 14, there being junctions 16 and 17 of the channel web 15 with the first and second side walls 13 and 14, respectively. A stub wall 18, which is a portion of the lead wall structure 12, co-extends longitudinally with the channel web 15 and has a junction 19 at the rear of the channel web 15 with first and second portions 15*a* and 15*b* of the channel web 15. The first and second side walls 13 and 14 of the channel 11 and the stub wall 18 laterally form approximately right angles with the channel web 15, having the junction 19 disposed marginally inward from the junctions 16 and 17, and junction 19 leads longitudinally substantially parallel with the junctions 16 and 17 with the molding shaft 10 meanwhile being in the longitudinally straight condition indicated in FIG. 1. Approximaltely right angle coves 20 and 21 are laterally produced behind the channel 11 by the stub wall 18 with the first and second portions 15*a* and 15*b* of the channel web 15.

A lead wall 22, being a further portion of the lead wall structure 12, forms on the length of the molding shaft 10 a junction 23 with an outer end of the stub wall 18 rearward of the junction 19. As represented in FIG. 1, junction 23 leads longitudinally substantally parallel with junction 19 in the molding shaft 10 in the longitudinally straight condition of the molding shaft 10, meanwhile having the lead wall 22 and channel web 15 substantially coincident with parallel planes and having the lead and wall 22 and the stub wall 18 form approximately a right angle with one another. The lead wall 22 extends laterally outwardly in the molding shaft 10 past and thus beyond the second side wall 14 of the channel 11 and is adapted to contact sub-structure of a building and be fastened to that sub-structure. Notably, too, the stub wall 18 offsets the channel 11 forwardly from the lead wall 22 and, as compared with the depth of the molding shaft 10, the forwardly open channel 11 is relatively shallow as presented forwardly of the coves 20 and 21. In the present embodiment, the junction 19 substantially coincides with the longitudinal center line of the channel web 15 so as to have the ratio of lateral reach from junction 16 into cove 20 to junction 19, to lateral reach from junction 17 into cove 21 to junction 19, be approximately 1:1. If desired, in practice still in accordance with the present invention, any one of a number of other ratios for lateral reaches respectively corresponding to those just expressed may be introduced, instead of the aforementioned approximately 1:1 ratio referred to for the molding shaft 10, in producing molding shafts otherwise similar to the molding shaft 10. The ratio selected for this purpose is preferably in the range of about 3:1 to and including the ratio of approximately 1:1 already mentioned. In the present embodiment, the molding shaft 10 further includes a flange 10*a* joined to the forward end of the second side wall 14 of the channel 11 and reaching laterally outwardly of the channel 11 a short distance at about a right angle to the second side wall 14, thus laterally being substantially parallel with the lead wall 22 and providing an extension of the reveal surface introduced by the forwardly open channel 11 and being available to conceal the end of finish material which is to be placed immediately behind the flange 10*a* so as to have the latter afford a terminal end of the reveal. In certain embodiments, the flange 10*a* is omitted, calling for the finish material to be more closely abutted against the channel 11 second side wall 14, thus laterally terminally ending the reveal at the forward end of the second side wall 14.

Turning to examples of installations in accordance with the present invention and of how the molding shaft 10 may be interrelated with building materials, it will be noted with reference to FIG. 2 that the molding shaft 10, therein represented as installed, is associated with first and second building side wall sub-structural extents 25 and 26 and with first and second side wall finish materials 27 and 28 which may be substantially alike or of different composition applied to conceal the sub-structural side wall extents 25 and 26 in a building corner environment. In the course of finishing the corner, the first finish material 27, such as fluent settable plaster or dry wall paneling, is for example first applied to the sub-structural extent 25, following which the lead wall 22 of the molding shaft 10 is placed against the sub-structural extent 26 and secured as by nails 29 to the sub-structural extent 26 having the first side wall 13 of the channel 11 abutted against the first finish material 27. Thereafter, the second finish material 28 is applied against the second side wall 14 of the channel 11, thereby concealing the side wall 14 exteriorly of the channel 11, the cove 21, the lead and contact wall 22 and the sub-structural extent 26, and leaving the interior of the channel 11 revealed forwardly as trim. Where the second finish material 28 used is a fluent settable material, the cove 21 becomes accessible for the second finish material 28 to enter and produce a cleat, meanwhile having the flange 10*a* available to serve for a working ground along with the second side wall 14 of channel 11.

In certain practices, still in accordance with the present invention, and which practices also can be understood by again referring to FIG. 2, the molding shaft 10 is installed against the second sub-structural extent 26 before application of the first finish material 27 outside the first sub-structural extent 25, and allowance is made either to slide dry paneling, or the like, as the first finish material 27 into position within a gap between the first side wall 13 of the channel 11 and the sub-structural extent 25 so as to be outside the channel 11 and against the first side wall 13, or to apply fluent settable finish material to enter the gap between the first side wall 13 and the first sub-structural extent 25 and be contiguous to the cove 20, such as to enter that cove, using the first side wall 13 for a working ground.

Molding shaft 10 also readily lends itself to use in building side wall and ceiling corner or soffit environments such as is represented in FIGS. 3 and 4. In the FIG. 4 ceiling corner environment, the lead wall 22 is fastened, as by nailing, to a sub-structural ceiling extent 30, and is thereafter covered by ceiling finish material 32, with the first side wall 13 of the channel 11 being against building side wall finish material 33 applied to a side wall sub-structural extent 31. The installation in FIG. 3 has the molding shaft 10 in a soffit situation wherein there is an upper sub-structural corner 34 with the lead wall 22 of the molding shaft 10 fastened, as by nailing, to a horizontal underside of the sub-structural corner 34. Meanwhile, the first side wall 13 of the channel 11 is disposed against the side of a vertically downwardly projecting end 36 of dry wall finish material which above covers the vertical side of the sub-structural corner 34.

In the FIG. 5 embodiment, a molding shaft 10', similar to the molding shaft 10 in FIG. 1, includes a second lead wall 22' supplementing the first lead wall 22. Lead wall 22' extends laterally outwardly past and appreciably beyond the first side wall 13 of the channel 11 from a junction 23' in common with the stub wall 18 and the first lead wall 22, both lead walls 22' and 22 being substantially within a plane in common for a longitudinally straight condition of the molding shaft 10'. It will be appreciated from FIG. 5 that the molding shaft 10' has utility such as to situate the channel 11 between dry finish type panels, or between sections of fluent settable plaster type finish materials, or between one of each of the two types of materials, this with the materials being substantially within a plane in common, and which materials in any event are designated by the reference numerals 39 and 40, and cover both of the lead walls 22' and 22 which are secured to the sub-structure 38 as by nailing. It will be seen, too, that a second flange 10*b*, similar to the flange 10*a* for the second side wall 14 has been added to the outer end of the first side wall 13 of the channel 11 and reaches laterally outwardly at about a right angle relatively to the first side wall 13 of the channel 11 a short distance for being associated in a manner similar to the flange 10*a* with the corresponding finish material. For use in a similar environment, a molding shaft 10 according to FIG. 1 may instead be provided and installed with or without the addition of the flange 10*b* as suggested from FIG. 5.

Referring now to the FIG. 6 embodiment, a molding shaft 50 is suited to present a decorative channel reveal in a bevel sense across a finished sub-structural corner, and also serves as a ground for the finish material. Molding shaft 50 includes a lead wall 51 and an allocating wall 52 co-extending with one another longitudinally of the molding shaft 50 and with a channel 55 and a stub wall 53. Laterally, the walls 51 and 52 are disposed at about a right angle relatively to one another so as to receive against their inner surfaces a sub-structural corner 66 of a building when the molding shaft 50 is being installed.

The stub wall 53 has a first junction 54 at rearward end in common with the walls 51 and 52 and forms substantially 135° outside angles with the walls 51 and 52. At forward end, the stub wall 53 has a second junction 56 with first and second portions 57*a* and 57*b* of a web 57 of the channel 55 and introduces approximately right angle coves 60 and 61 with the web portions 57*a* and 57*b* behind the channel web 57. First and second side walls 58 and 59 of the channel 55 for a longitudinally straight condition of the molding shaft 50 are substantially concurrent with first and second substantially perpendicular planes which intersect the walls 51 and 52, at about right angles, rearwardly laterally in the molding shaft 50 of the stub wall junction 54 and intersect one another along an axis x behind the stub wall junction 54.

The stub wall junction 56 with the first and second portions 57*a* and 57*b* of the channel web 57 is laterally removed substantially equidistantly from junctions 62 and 63 of the channel web 57 with the first and second side walls 58 and 59 of the channel 55, and these side walls 58 and 59 form about 135° angles with the channel web 57 inside the channel 55. The molding shaft 50 further comprises a pair of flange walls 64 and 65 integral with the forward ends of the channel side walls 58 and 59 and directed laterally outwardly in the molding shaft 50 at about right angles to the channel side walls 58 and 59 respectively, and terminating with a shorter lateral reach than the lead wall 51 and the allocating wall 52. The flange walls 64 and 65 afford lateral terminal ends for the reveal wall structure.

With the molding shaft 50 fastened in place against the sub-structural corner 66, as represented in FIG. 6, first finish material 67 is applied exteriorly of the channel 55 against the channel first side wall 58, up to contiguously behind the flange wall 64, and against the sub-structural corner 66, so as to conceal the exterior face of the channel first side wall 58, the cove 60, the lead wall 51 and the related face of the sub-structural corner 66. Where the finish material 67 used is a dry wall panel presenting a square cut at the end adjacent to the channel first side wall 58, the panel end does not enter the cove 60 but merely closes off that cove from the outside; however, the panel may be provided with a tongue, if desired, to enter the cove 60. On the other hand, where the first finish material 67 is applied as a fluent settable material, the flange wall 64 is useful for a troweling ground, and the first finish material 67 can enter the cove 60 for cleating. Similar options are available in applying second finish material 68 relatively to the second side wall 59 of the channel 55 and the flange wall 65, for concealing the cove 61, the allocating wall 52 and the related surface of the sub-structural corner 66.

In certain embodiments, the allocating wall 52 is omitted from the structure of the molding shaft 50 with reliance accordingly being placed upon use of the lead wall 51 for placement and fastening of the molding shaft 50 against a sub-structural corner. The supplemental use of the allocating wall 52, though, is preferred, at least to facilitate allocation of the molding shaft 50 against the sub-structural corner, with or without the allocating wall 52 being used with fasteners for connecting the molding shaft 50 to the sub-structural corner.

A molding shaft 70 according to the FIG. 7 embodiment has utility for such purposes as with a sub-structural soffit. Lead wall structure in the molding shaft 70 comprises a stub wall 71 and first and second lead walls 72 and 73, the second lead wall 73 laterally forming a first lead wall angle with the first lead wall 72 and a second lead wall angle with the stub wall 71, both of these angles being approximately right angles. A first lateral end 72*a* of the lead wall structure is presented by an outer end of the first lead wall 72, and a second lateral end of the lead wall structure is presented at junction 71*a* of an end of the stub wall 71 with the web 77 of a channel 74. First and second side walls 75 and 76 of the channel 74 are joined at 75*a* and 76*a* with the outer ends of first and second portions 77*a* and 77*b* of the channel web 77 and are disposed at about right angles to the channel web 77 so as to have the channel 74 interiorly provide a forwardly open reveal.

The stub wall junction 71*a* is at the rear of the channel 74 and is at approximately the longitudinal center line of the channel web 77. Stub wall 71 serves as a boundary of first and second approximately right angle coves 78 and 79 which respectively have the web portions 77*a* and 77*b* for further boundaries, the stub wall 71 accordingly offsetting the channel 74 forwardly in the molding shaft 70 from the second lead wall 73 of the lead wall structure so as to have the ratio of lateral reach from junction 75*a* into cove 78 to junction 71*a*, to lateral reach from junction 76*a* into cove 79 to junction 71*a*, be approximately 1:1. If desired, in practices still in accordance with the present invention, any one of a number of other ratios for lateral reaches respectively corresponding to those just expressed may be introduced, instead of the aforementioned approximately 1:1 ratio referred to for the molding shaft 70, in producing molding shafts otherwise similar to the molding shaft 70. The ratio selected for this purpose is preferably in the range of about 1:3 to and including the ratio of approximately 1:1 already mentioned.

For a longitudinally substantially straight condition of the molding shaft 70, the first lead wall 72 and the first side wall 75 of channel 74 are substantially in alignment with one another by being substantially coincident with a plane in common thereto, and also in the present embodiment the molding shaft 70 is characterized by further including a ledge wall 80 which is connected at inner end outside the channel 74 with an outer end of the first side wall 75 of the channel 74 and projects laterally outwardly from the first side wall 75 to provide, forwardly, a reveal surface 80*a* extended from the interior reveal of the channel 74. Rearwardly, the ledge wall 80 has a surface 80*b* which is to be concealed. Channel 74 and the ledge wall 80 accordingly provide a reveal wall structure, and in the present embodiment this reveal wall structure is supplemented by a first flange 81 connected at about a right angle with the outer end of the ledge wall 80 and projecting rearwardly of the ledge wall 80 a small distance thus presenting an end 81*a*. A first lateral terminal end of the reveal wall structure accordingly is provided by the rearward end 81*a* of the first flange 81. A second flange 82 connected at about right angle with the outer end of the second side wall 76 of the channel 74 and projecting a small distance laterally outwardly of the second side wall 76 presents a second lateral terminal end 82*a* of the reveal wall structure.

It will further be understood that in the FIG. 7 embodiment the molding shaft 70 has the first lead wall 72 adapted to be secured to a substantially vertical portion of a sub-structural soffit corner 85 of a building such as by means of nails 86, and meanwhile have the second lead wall 73 in position against a substantially horizontal portion of the sub-structural soffit corner 85 with the stub wall 71 leading downward substantially vertically. With the first lead wall 72 thus securely in place, first finish material 87 thereafter is applied outside the molding shaft 70 and contiguous to the first lead wall 72, the first side wall 75 of the channel 74 and still further contiguous to the rearward face 80*b* of the ledge wall 80 and the inner side of flange 81 for the first finish material 87 thereafter to afford a substantially vertical external face outside the sub-structural soffit corner 85, with the exterior face of the flange 81 initiating a reveal of the molding shaft 70 for the soffit. A second finish material 88 is applied endwise contiguous to the second side wall 76 of the channel 74 and the rearward side of the flange 82 so as to have the flange 82 terminate the reveal of the molding shaft 70 for the soffit and the second finish material 88 thereafter to afford a substantially horizontal exposed face of the soffit. Under the latter conditions, the first and second finish materials 87 and 88 conceal the sub-structural soffit corner 85, the lead wall structure inclusive of the first and second lead walls 72 and 73 and the stub wall 71, the coves 78 and 79 and the outside faces of the first and second side walls 75 and 76 of the channel 74 along with the rearward face 80*b* of the ledge wall 80.

The first and second finish materials 87 and 88, referred to, may of course in composition be similar or different, and either of these materials may be of a fluent settable type or of a dry wall type. Where the material is applied as a fluent settable material, the related cove 78 or 79 is available to receive cleating of the material and the first and second flange 81 or 82, as the case may be, is present as a guide for troweling or screeding, or in the instance of a pre-formed panel or board the inner flange face is available as an abutment.

In practice in accordance with the present invention, the molding shafts in the embodiments hereinbefore disclosed, aside from being produced and used in a substantially longitudinally straight condition, are instead produced and used in a longitudinally curved condition to satisfy certain needs. For the longitudinally straight condition as compared with the longitudinally curved condition of a molding shaft so produced, the transverse cross section of the longitudinally straight molding shaft may be similar to that of the longitudinally curved molding shaft, such as by derivation from the same extrusion die or from similar extrusion dies. To provide examples of longitudinal curvatures given to molding shafts in accordance with the present invention, reference is had to the molding shaft 70 in the FIG. 7 embodiment, and to FIGS. 8, 9, 10 and 11 wherein a variety of longitudinal curvatures which introduce curvature two-dimensionally as distinguished from three-dimensionally are presented for selection. The longitudinal curvatures represented for molding shaft 70 are respectively a bow laterally to the left in FIG. 8, a bow laterally to the right in FIG. 9, a forward arching in FIG. 10 and a rearward arching in FIG. 11, this in terms of the molding shaft 70 being viewed toward the front thereof, and thus in an upward direction from below in FIGS. 8, 9, 10 and 11. The molding shafts in the other embodiments herein are also provided and used either in a longitudinally straight condition or in a longitudinally curved condition, and with the longitudinal curvatures being similar for example to any one of those aforementioned with reference to FIGS. 8, 9, 10 and 11.

As the invention lends itself to many possible embodiments and as many possible changes may be made in the embodiments hereinbefore set forth, it will be distinctly understood that all matter described herein is to be interpreted as illustrative and not as a limitation.

I claim:

1. A molding shaft adapted to be associated with sub-structure of a building and be disposed intermediately of finish material, said molding shaft comprising, reveal wall structure including, a laterally open channel having an interior to be revealed as trim between first and second lateral terminal ends of said reveal wall structure, and said channel comprising, first and second side walls having outside surfaces to be concealed, and a web having a first junction with said first side wall of said channel and a second junction with said second side wall of said channel, said channel side walls laterally being straight walls forming approximately equal angles of either about a right angle and about a 135 degree angle in magnitude with said web, and said reveal wall structure further comprising a first flange outside said channel, said first flange being connected with an outer lateral end of one of said side walls of said channel and having forward and rearward surfaces and said first lateral terminal end of said reveal wall structure, for said finish material to extend behind said rearward surface of said first flange and thus be locally masked by said first flange while having said forward surface of said first flange and said interior of said channel revealed as trim between said first and second lateral terminal ends of said reveal wall structure, and said said molding shaft further including lead wall structure comprising, a stub wall, and a lead wall connected with said stub wall and forming a lead wall angle with said stub wall laterally of said molding shaft about equal to each of said angles formed by said side walls of said channel with said web, said lead wall having a lateral free end and extending laterally of said molding shaft beyond said channel outwardly aside from said one of said side walls of said channel to said lateral free end, said stub wall having a lateral end at junction with the rear of said channel web marginally inwardly from said junctions of said channel web with said first and second side walls of said channel, and said stub wall forming first and second substantially right angular coves with said web and offsetting said web from said lead wall, for said lead wall to be fastened laterally aside from said one of said channel side walls to said sub-structure having said lead wall against said sub-structure and for said finish material when placed substantially at said lateral terminal ends of said reveal wall structure and said first and second side walls of said channel, and substantially at said sub-structure and said coves and behind said first flange to conceal said sub-structure, said lead wall structure and said outside surfaces of said side walls of said channel, so as to have the interior of said channel along with said forward surface of said first flange exposed as trim between said lateral terminal ends of said reveal wall structure.

2. A molding shaft as set forth in claim 1, wherein said angle formed by said lead wall with said stub wall and said angles formed by said channel side walls with said web are about right angles.

3. A molding shaft as set forth in claim 1, wherein said angle formed by said lead wall with said stub wall and said angles formed by said channel side walls with said web are about 135 degree angles.

4. A molding shaft as set forth in claim 3, wherein said molding shaft further includes an allocating wall having a junction in common with said lead wall and said stub wall, and said lead wall and said allocaing wall form about 135 degree angles with said stub wall and about a right angle with one another, for said lead wall and said allocating wall to be against a sub-structural corner and said lead wall to be fastened to said sub-structural corner.

5. A molding shaft as set forth in claim 1, wherein said angle formed by said lead wall with said stub wall and said angles formed by said channel side walls with said web are about right angles, said first flange is on said first side wall of said channel and said lead wall laterally extends beyond said channel outwardly aside from said first side wall of said channel to said lateral free end, for said lead wall to be fastened laterally aside from said first side wall of said channel to said sub-structure, and an outer lateral end of said second side wall of said channel provides said second lateral terminal end of said reveal wall structure, for said finish material to extend behind said rearward surface of said first flange and thus be locally masked by said first flange while having said forward surface of said first flange and said interior for said channel revealed as trim between said lateral terminal ends of said reveal wall structure.

6. A molding shaft as set forth in claim 1, wherein said first flange is on said first side wall of said channel and said reveal wall structure further comprises a second flange outside said channel, said second flange being connected with an outer lateral end of said second side wall of said channel, and said second flange having forward and rearward surfaces and providing said second lateral terminal end of said reveal wall structure, for said finish material to extend behind said rearward surfaces of said flanges and thus be locally masked by said flanges while having said forward surfaces of said flanges and said interior of said channel revealed as trim between said lateral terminal ends of said reveal wall structure.

7. A molding shaft as set forth in claim 6, wherein said angle formed by said stub wall with said lead wall and said angles formed by said channel side walls are about right angles.

8. A molding shaft as set forth in claim 6, wherein said angle formed by said stub wall with said lead wall and said angles formed by said channel side walls with said web are approximately 135 degree angles.

9. A molding shaft as set forth in claim 6, wherein said molding shaft further includes an allocating wall having a junction in common with said lead wall and said stub wall, and said lead wall and said allocating wall form about 135 degree angles with said stub wall and about a right angle with one another, for said lead wall and said allocating wall to be against a sub-structural corner and said lead wall to be fastened to said sub-structural corner.

10. A molding shaft adapted to be associated with a sub-structural corner of a building and be disposed intermediately of finish material, said molding shaft comprising, reveal wall structure including, a laterally open channel having an interior to be revealed as trim between first and second lateral terminal ends of said reveal wall structure, and said channel comprising, first and second side walls having outside surfaces to be concealed, and a web, said web having a first junction with said first side wall of said channel and a second junction with said second side wall of said channel, and said first and second side walls of said channel being laterally straight walls and forming about right angles with said web, and said molding shaft further including lead wall structure comprising, a stub wall, and first and second lead walls forming an about right first lead wall angle with one another for said first and second lead walls to be against said sub-structural corner and said first lead wall to be fastened to said sub-structural corner, and said lead wall structure having first and second lateral ends and said stub wall having said second lateral end of said lead wall structure at junction with the rear of said channel web marginally inwardly from said junctions of said channel side walls with said web, and said stub wall forming first and second about right angular coves with said channel web and about a right second lead wall angle with said second lead wall behind said channel so as to have channel web and said second lead wall opposite one another, said first lead wall including said first lateral end of said lead wall structure and being substantially aligned laterally of said molding shaft with said first side wall of said channel, so that when said first lead wall is fastened to said sub-structural corner having said first and second lead walls against said sub-structural corner, and said finish material is placed substantially at said first and second lateral terminal ends of said reveal wall structure and substantially at said outside surfaces of said channel side walls and said coves and against said sub-structural corner, said finish material conceals said sub-structural corner, said lead wall structure and said outside surfaces of said channel side walls. so as to have the interior of said channel exposed as trim between said first and second lateral terminal ends of said reveal wall structure.

11. A molding shaft as set forth in claim 10, wherein a said lateral terminal end of said reveal wall structure is provided by a flange of said reveal wall structure, and said flange is disposed outside said channel and connected with said second side wall of said channel, for being forwardly revealed as trim and locally covering said finish material.

12. A molding shaft as set forth in claim 10, wherein said reveal wall structure further includes a ledge wall outside said channel and joined to said first side wall of said channel, for said finish material, when placed longitudinally end wise against a rearward surface of said ledge wall, to be masked by said ledge wall with said ledge wall being forwardly revealed as trim.

13. A molding shaft as set forth in claim 12, wherein said reveal wall structure further includes a flange outside said channel and joined to said second side wall of said channel, for said flange to mask said finish material locally, when said finish material longitudinally endwise is against said outside surface of said second side wall of said channel with said flange being forwardly revealed as trim.

14. A molding shaft adapted to be associated with sub-structure of a building and be disposed intermediately of finish material, said molding shaft comprising, reveal wall structure including, a laterally open channel having an interior to be revealed as trim between first and second lateral terminal ends of said reveal wall structure, and said channel comprising, first and second side walls having outside surfaces to be concealed, and a web having a first junction with said first side wall of said channel and a second junction with said second side wall of said channel, said channel side walls being laterally straight walls forming approximately equal angles of either about a right angle and about a 135 degree angle in magnitude with said web, and said reveal wall structure further comprising a first flange outside said channel, said first flange being connected with an outer lateral end of said first side wall of said channel and having forward and rearward surfaces and said first lateral terminal end of said reveal wall structure, for said finish material to extend behind said rearward surface of said first flange and thus be locally masked by said first flange while having said forward surface of said first flange and said interior of said channel revealed as trim between said first and second lateral terminal ends of said reveal wall structure, and said molding shaft further including lead wall structure comprising, stub wall means connected with said channel web marginally inwardly laterally of said molding shaft from said junctions of said first and second side walls of said channel with said web, and said stub wall means being disposed behind said channel between first and second coves formed by said stub wall means with said web, and a lead wall forming a lead wall angle with said stub wall means laterally of said molding shaft, having said channel offset from said lead wall by said stub wall means, and said lead wall having a lateral free end and being directed approximately 90 degrees differently than at least one of said first and second side walls of said channel laterally of said molding shaft and extending laterally of said molding shaft beyond said channel outwardly aside from one of said side walls of said channel to said lateral free end, for said lead wall to be fastened laterally aside from said one of said channel side walls to said sub-structure having said lead wall against said sub-structure, and for said finish material when placed substantially at said lateral terminal ends of said reveal wall structure and said first and second side walls of said channel, and substantially at said sub-structure and said coves and behind said first flange, to conceal said sub-structure, said lead wall structure and said outside surfaces of said side walls of said channel, so as to have the interior of said channel along with said forward surface of said first flange exposed as trim between said lateral terminal ends of said reveal wall structure.

15. A molding shaft as set forth in claim 14, wherein said angles formed by said channel side walls with said web are about right angles.

16. A molding shaft as set forth in claim 15, wherein an outer lateral end of said second side wall of said channel includes said second lateral terminal end of said reveal wall structure, and said lead wall extends laterally of said molding shaft beyond said channel outwardly aside from said first side wall of said channel to said lateral free end of said lead wall, for said lead wall to be fastened laterally aside from said first side wall of said channel to said sub-structure.

17. A molding shaft as set forth in claim 15, wherein said reveal wall structure further comprises a second flange outside said channel and said second flange connected with an outer lateral end of said second side wall of said channel and having forward and rearward surfaces and said second lateral terminal end of said reveal wall structure, for said finish material to extend behind said rearward surfaces of said flanges and thus be locally masked by said flanges while having said forward surfaces of said flanges and said interior of said channel revealed as trim between said lateral terminal ends of said reveal wall structure.

18. A molding shaft as set forth in claim 14, wherein said angles formed by said channel side walls with said web are about 135 degree angles.

19. A molding shaft as set forth in claim 18, wherein said reveal wall structure further comprises a second flange outside said channel and said second flange connected with an outer lateral end of said second side wall of said channel, said second flanges having forward and rearward surfaces and said second lateral terminal end of said reveal wall structure, for said finish material to extend behind said rearward surfaces of said flanges and thus be locally masked by said flanges while having said forward surfaces of said flanges and said interior of said channel revealed as trim between said lateral terminal ends of said reveal wall structure.

20. A molding shaft as set forth in claim 19, wherein said molding shaft further includes an allocating wall joined to said lead wall and said stub wall means and forming about a right angle with said lead wall, for said allocating wall and said lead wall to be against a sub-structural corner and said lead wall to be fastened to said sub-structural corner.

21. A molding shaft adapted to be associated with a sub-structural corner of a building and be disposed intermediately of finish material, said molding shaft comprising, reveal wall structure including, a laterally open channel having an interior to be revealed as trim between first and second lateral terminal ends of said reveal wall structure, and said channel comprising, first and second side walls having outside surfaces to be concealed, and a web, said web having a first junction with said first side wall of said channel and a second junction with said second side wall of said channel, and said first and second side walls of said channel being laterally straight walls and forming about right angles with said web, and said molding shaft further including lead wall structure comprising, first and second lead walls forming approximately a right lead wall angle with one another laterally of said molding shaft for said first and second lead walls to be against said sub-structural corner and said first lead wall to be fastened to said sub-structural corner, and stub wall means connected with said channel web marginally inwardly laterally of said molding shaft from said junctions of said first and second side walls of said channel with said web, and said stub wall means being disposed between first and second coves formed by said stub wall means with said web having said channel offset from said second lead wall and connected therewith by said stub wall means with said second lead wall leading substantially parallel with said web behind said channel, and said first lead wall including a free lateral end of said lead wall structure and being substantially aligned laterally of said molding shaft with said first side wall of said channel, so that when said first lead wall is fastened to said sub-structural corner having said first and second lead walls against said sub-structural corner, and said finish material is placed substantially at said first and second lateral terminal ends of said reveal wall structure and substantially at said outside surfaces of said channel side walls and said coves and against said sub-structural corner, said finish material conceals said sub-structural corner, said lead wall structure and said outside surfaces of said channel side walls, so as to have the interior of said channel exposed as trim between said first and second lateral terminal ends of said reveal wall structure.

22. A molding shaft as set forth in claim 21, wherein a said lateral terminal end of said reveal wall structure is provided by a flange of said reveal wall structure, and said flange is disposed outside said channel and connected with said second side wall of said channel, for being forwardly revealed as trim and locally covering said finish material.

23. A molding shaft as set forth in claim 21, wherein said reveal wall structure further includes a ledge wall outside said channel and joined to said first side wall of said channel, for said finish material, when placed longitudinally endwise against a rearward surface of said ledge wall, to be masked by said ledge wall with said ledge wall being forwardly revealed as trim.

24. A molding shaft as set forth in claim 23, wherein said reveal wall structure further includes a flange outside said channel and joined to said second side wall of said channel, for said flange to mask said finish material locally, when said finish material longitudinally endwise is against said outside surface of said second side wall of said channel with said flange being forwardly revealed as trim.

25. In combination with sub-structure of a building and finish material, a molding shaft comprising, reveal wall structure including, a laterally open channel and first and second lateral terminal ends, and said channel comprising, first and second side walls and a web having a first junction with said first side wall of said channel and a second junction with said second side wall of said channel, said channel side walls being laterally straight walls forming approximately equal angles of either about a right angle and about a 135 degree angle in magnitude with said web, and said molding shaft further including lead wall structure comprising, stub wall means connected with said channel web marginally inwardly laterally of said molding shaft from said junctions of said first and second side walls of said channel with said web, and said stub wall means being disposed behind said channel between first and second coves formed by said stub wall means with said web, and a lead wall forming a lead wall angle with said stub wall means, laterally of said molding shaft, having said channel offset from said lead wall by said stub wall means, and said lead wall being directed approximately 90 degrees differently than at least one of said first and second side walls of said channel laterally of said molding shaft with said lead wall against said sub-structure and said lead wall structure fastened to said sub-structure, and with said finish material in place substantially at said lateral terminal ends of said reveal wall structure and the outside surfaces of said first and second side walls of said channel, and substantially at said sub-structure and said coves, and concealing said sub-structure, said lead wall structure and said outside surfaces of said channel side walls, so as to have the interior of said channel exposed as trim between said lateral terminal ends of said reveal wall structure.

26. The combination as set forth in claim 25, wherein said stub wall means includes a stub wall disposed behind said channel and joined to said web marginally inwardly laterally of said molding shaft from said junctions of said channel side walls with said web, and said coves are approximately right angle coves formed by said stub wall with said web on opposite sides of said stub wall.

27. The combination as set forth in claim 25, wherein said angles formed by said channel side walls with said web are about right angles, and said lead wall has a lateral free end and laterally extends substantially parallel with said channel web and beyond said channel outwardly aside from said first side wall of said channel to said lateral free end, and is fastened laterally aside from said first side wall of said channel to said sub-structure.

28. The combination as set forth in claim 27, wherein a flange of said reveal wall structure is disposed outside said channel and connected with an outer lateral end of said first side wall of said channel, and a lateral end of said flange and an outer lateral end of said second side wall of said channel are said first and second lateral terminal ends of said reveal wall structure, and said sub-structure includes a sub-structural corner wherein said lead wall is fastened laterally aside from said first side wall of said channel to a first side of said sub-structural corner, with said finish material extending between said second side of said sub-structural corner and said second side wall of said channel and being behind said flange and substantially at said first side wall of said channel outside said channel, thus having a forward surface of said flange, the interior of said channel, and said lateral outer end of said second side wall of said channel revealed as trim.

29. The combination as set forth in claim 27, wherein first and second flanges of said reveal wall structure are disposed outside said channel and connected with outer lateral ends of said first and second side walls of said channel, and said first and second flanges include said first and second lateral terminal ends of said reveal wall structure.

30. The combination as set forth in claim 25, wherein said angles formed by said channel side walls with said web are about 135 degree angles, and said lead wall has a lateral free end and laterally extends beyond said channel outwardly aside from said first side wall of said channel to said lateral free end, and said sub-structure includes a sub-structural corner having said lead wall fastened laterally aside from said first side wall of said channel to a first side of said sub-structural corner, and said finish material covers both sides of said sub-structural corner having said channel disposed in a corner beveling sense relatively to said finish material.

31. The combination as set forth in claim 30, wherein first and second flanges providing said first and second lateral terminal ends of said reveal wall structure are disposed outside said channel, are connected with outer lateral ends of said first and second side walls of said channel and overlap said finish material so as to have outside surfaces revealed as trim along with the interior of said channel.

32. In combination with a sub-structural corner of a building and finish material, a molding shaft comprising, reveal wall structure including a laterally open channel and first and second lateral terminal ends, said channel comprising, first and second side walls and a web having a first junction with said first side wall of said channel and a second junction with said second side wall of said channel, said channel side walls being laterally straight walls forming approximately right angles with said channel web and having surfaces outside said channel, and said molding shaft further including lead wall structure comprising, first and second lead walls forming approximately a right lead wall angle with one another laterally of said molding shaft, and stub wall means connected with said channel web marginally inwardly laterally of said molding shaft from said junctions of said first and second side walls of said channel with said web, and said stub wall means being disposed between first and second coves formed by said stub wall means with said web, having said channel offset from said second lead wall and connected therewith by said stub wall means with said second lead wall leading substantially parallel with said web behind said channel, and said first lead wall including a free lateral end of said lead wall structure and being substantially aligned laterally of said molding shaft with said first side wall of said channel, having said first lead wall fastened against a first side of said sub-structural corner to said sub-structural corner while having said second lead wall against a second side of said sub-structural corner, and said finish material being in place substantially at said first and second lateral terminal ends of said reveal wall structure and said coves and against said sub-structural corner and concealing said sub-structural corner, said lead wall structure and said outside surfaces of said channel side walls, so as to have the interior of said channel exposed as trim between said first and second lateral terminal ends of said reveal wall structure.

33. The combination as set forth in claim 32, wherein a first flange providing one of said first and second lateral terminal ends of said reveal wall structure is disposed outside said channel in overlap with said finish material and is connected with said second side wall of said channel, and locally conceals said finish material while being forwardly revealed as trim.

34. The combination as set forth in claim 32, wherein said reveal wall structure further includes a ledge wall outside said channel and connected with said first side wall of said channel, with said finish material locally being longitudinally endwise against said ledge wall behind said ledge wall and said ledge wall being forwardly revealed as trim.

35. The combination as set forth in claim 34, wherein one of said first and second lateral terminal ends of said reveal wall structure is provided by a flange connected with said ledge wall, and said finish material extends between said ledge wall flange and said first side wall of said channel behind said ledge wall.

36. The combination as set forth in claim 35, wherein the other of said first and second lateral terminal ends of said reveal wall structure is provided by a flange outside said channel and connected with said second side wall of said channel.

* * * * *